US005489972A

United States Patent [19]

Shuster et al.

[11] Patent Number: 5,489,972

[45] Date of Patent: Feb. 6, 1996

[54] CLEANING MECHANISM FOR TRANSFER MEMBER

[75] Inventors: Frank A. Shuster, Rochester; Francisco L. Ziegelmuller, Penfield, both of N.Y.

[73] Assignee: Eastman Kodak Company, Rochester, N.Y.

[21] Appl. No.: 288,378

[22] Filed: Aug. 10, 1994

[51] Int. Cl.[6] ..... G03G 5/00

[52] U.S. Cl. ..... 355/212; 355/274

[58] Field of Search ..... 355/211–213, 274, 355/296, 273

[56] References Cited

U.S. PATENT DOCUMENTS

| | | | |
|---|---|---|---|
| 4,183,655 | 1/1980 | Umahashi et al. | 355/274 |
| 4,758,486 | 7/1988 | Yamazaki et al. | 355/212 X |
| 5,079,597 | 1/1992 | Mauer et al. | 355/303 |
| 5,124,757 | 6/1992 | Ikegawa | 355/296 |
| 5,132,738 | 7/1992 | Nakamura et al. | 355/274 |
| 5,182,604 | 1/1993 | Asai | 355/273 |
| 5,187,526 | 2/1993 | Zaretsky | 355/273 |
| 5,286,542 | 2/1994 | Susi et al. | 355/212 X |

*Primary Examiner*—William J. Royer
*Attorney, Agent, or Firm*—Leonard W. Treash, Jr.

[57] ABSTRACT

A series of toner images are formed on an endless belt having a splice. The toner images are transferred to a receiving sheet which is fed between the belt and a rotatable transfer member. The transfer member is cleaned by transferring toner back to the belt. Excess toner transfer from the splice of the belt to the transfer roller is obviated by either making the transfer member of a size that the toner will transfer back at an interframe area or applying a lacquer or other similar material to this splice to prevent the pickup of toner initially.

3 Claims, 1 Drawing Sheet

CLEANING MECHANISM FOR TRANSFER MEMBER

This invention relates to the transfer of toner images and, more specifically, to image forming apparatus having a transfer member, such as a roller, for maintaining intimate contact between a receiving sheet and a toner image carried by an image member, such as a photoconductive member.

Most modem electrophotographic image forming apparatus form a series of toner images on the surface of an image member, from which the images are transferred to a receiving sheet. One approach to transferring the toner images to a receiving sheet is to feed the receiving sheet between the image member and a transfer member, for example, a transfer roller. The transfer roller is biased to create an electric field urging the toner toward the sheet and also helps maintain intimate contact between the sheet and the toner image.

It is necessary to keep the transfer roller clean or it will apply toner to the back of the receiving sheet. The back of the sheet may also receive an image. Present commercial apparatus employ various methods for cleaning the transfer roller, including such extensive approaches as using a fur brash-vacuum cleaning device.

U.S. Pat. No. 5,187,526 shows a transfer roller used to assist transfer from an intermediate drum image member to a receiving sheet in which the transfer bias applied to the transfer roller is reversed when no image is present to transfer any toner on the transfer roller back to the intermediate where it may be cleaned off by another cleaning device otherwise necessary in the apparatus. This reference suggests that such back transfer is more effective if the transfer roller is coated with a 5 micron thick coating of a hard urethane resin sold under the tradename Permuthane® by Purmuthane, Inc., a division of ICI, Inc. This patent is hereby incorporated by reference herein.

U.S. Pat. No. 5,182,604 to Asai, granted Jan. 26, 1993 suggests a similar approach in transferring toner back to a photoconductive drum image member. See also, U.S. Pat. No. 5,132,738 to Nakamura, Jul. 21, 1993; U.S. Pat. No. 5,124,757, to Ikegawa, Jun. 23, 1992; and U.S. Pat. No. 4,183,655, to Umahashi et al, Jan. 15, 1980.

In U.S. Pat. No. 5,079,597, Mauer et al, granted Jan. 7, 1992, residual toner remaining on an intermediate drum is transferred back to a web photoconductor using a corona discharge for actively charging such particles to a polarity encouraging such transfer.

SUMMARY OF THE INVENTION

In attempting to eliminate expensive cleaners in apparatus employing a transfer member and an endless belt, for example, a photoconductive belt, we found that a reverse of the bias on the transfer member would successfully transfer toner to the belt between images in most instances. However, the passage of the belt's seam or splice through the transfer nip commonly left an amount of residual toner on the transfer member that showed up on the back of the next receiving sheet. This amount of toner is cleaned off by the more expensive fur brush cleaner previously used to clean the transfer member.

It is an object of the invention to provide an image forming apparatus in which toner images are formed on an endless, but spliced or seamed, belt and transferred to a receiving sheet using a rotatable transfer member, in which toner is cleaned off the transfer member by being transferred back to the belt without the problems associated with toner accumulation in the splice of the belt.

According to one aspect of the invention, this problem is solved by covering the splice on the photoconductive belt with a conductive material, electrically maintained at a low potential to prevent toner pickup in the first place.

According to another aspect of the invention, this object is accomplished by providing a transfer member having an intrack circumference approximately equal to the pitch of the images on the belt so that any transfer of toner to the transfer member from the splice is done so at a position on the transfer member that later contacts only the interframe area of the belt.

In general, an image forming apparatus using charged area development (CAD) has a device for exposing the interframe areas between images so that they have low potential and do not pick up toner when passing through the toning station. However, in forming the splice to make an endless belt, the conductive layer portion of the belt is generally destroyed or disconnected from its potential source (usually ground). The photoconductive layer may be destroyed as well. This prevents discharge of at least portions of the splice area using an interframe exposure. Thus, the splice area can pick up substantial amounts of toner from the toning station, some of which has a tendency to transfer to the transfer roller despite its reverse bias.

According to a preferred embodiment, the splice area is covered with a conventional conductive lacquer, for example, as part of the splicing operation. The lacquer is overlapped undestroyed portions of the conductive layer. That lacquer maintains the splice area at a low potential where it will not pick up toner in the toning station.

According to another preferred embodiment, even without the conductive lacquer, if a transfer roller is made of a circumference that brings the toner transferred from the splice back around to the transfer nip at the next interframe area, it will not impart an artifact to the backside of a receiving sheet. Preferably, the transfer roller would have a circumference approximately equal to the pitch of the images. Since the interframe has some finite width, it need not be exactly equal to the pitch.

DETAILED DESCRIPTION OF THE DRAWINGS

DETAILED DESCRIPTION OF THE INVENTION

Figure 1:
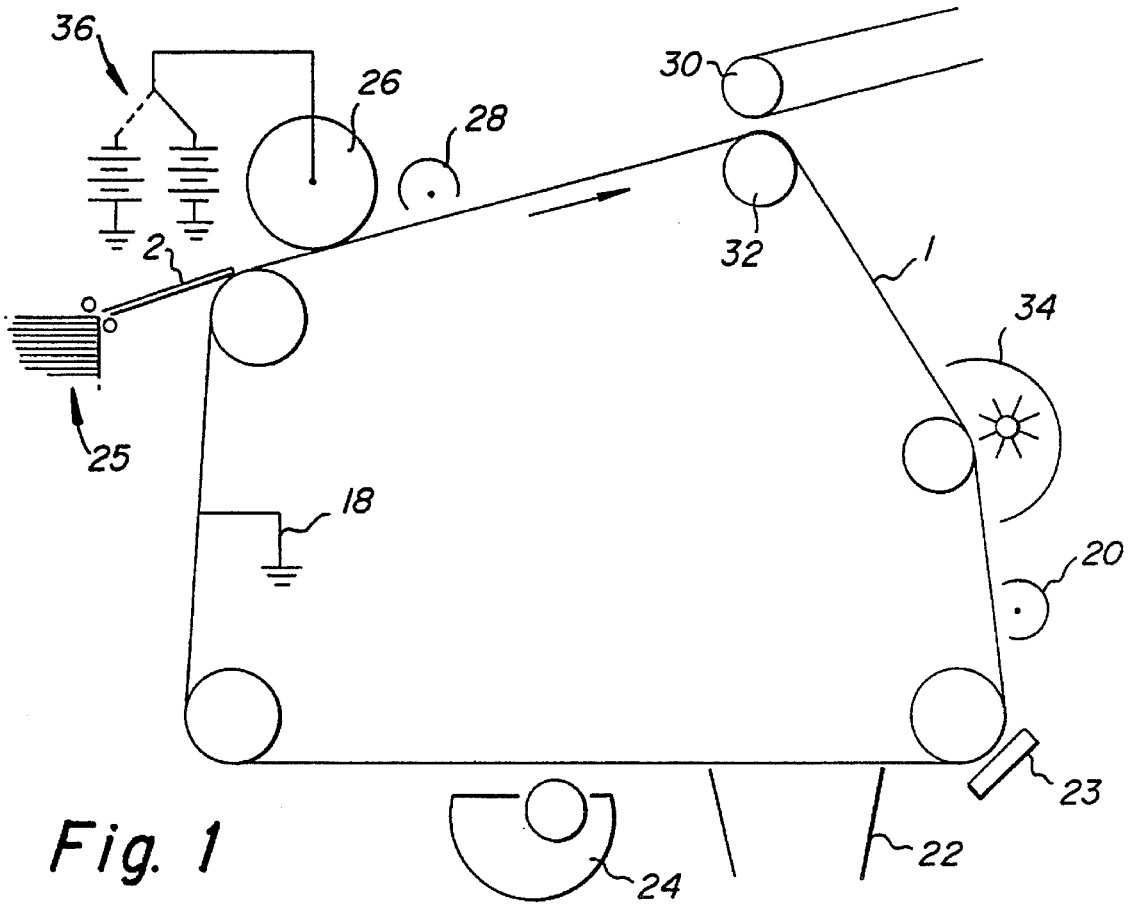
FIG. 1 is a side schematic of an image forming apparatus.
Figure 2:
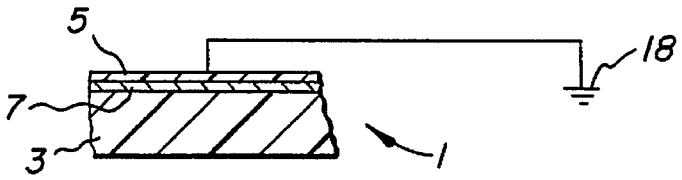
FIG. 2 is a schematic cross-section of a photoconductive belt.

According to FIG. 1, an image member, for example, a photoconductive belt 1 is trained about a series of rollers for movement through an endless path. The belt itself is shown in more detail in FIG. 2. It includes a support 3 which is generally not electrically conductive, an extremely thin conductive layer 7 and a photoconductive layer 5. It may also contain other layers that contribute to its operation. The photoconductive layer 5 is missing on the edge of the belt. For example, it can be coated across a narrower width than the conductive layer 7 or it can be cleaned off using a suitable solvent. This leaves the conductive layer 7 accessible at the edge of the belt for grounding through a roller or brash to a ground 18 in the image forming apparatus shown in FIG. 1. It is known commercially to improve the ability to contact the thin conductive layer by covering it with a carbon containing conductive lacquer.

As the belt 1 moves through its endless path, a charging station 20 uniformly charges the photoconductive layer 5. An exposing station 22 imagewise exposes the charged photoconductive layer to create an electrostatic image. A toning station 24 applies toner to the image to create a toner image. If CAD is used, the toner is of a polarity opposite to that of the charge applied by station 20 and adheres to the higher potential areas. An interframe erase lamp 23, which can be an LED printhead, exposes the interframe areas between images to prevent toner from adhering to them.

The toner image is transferred to a receiving sheet 2 fed from a receiving sheet supply 25 into a nip between photoconductive belt 1 and a transfer member, for example, a transfer roller 26. The transfer roller 26 engages belt 1 to force the receiving sheet into intimate contact with the toner image. It is biased to a potential creating an electric field urging the transfer of toner to the receiving sheet. For example, if an original charge put on the photoconductive belt by charging station 20 is negative and CAD is used, the toner will be positive. Thus, a high potential, say, 1500 volts negative potential, is applied to roller 26.

After transfer, the receiving sheet is subject to a corona discharge 28 to remove static and help in its release from belt 1. As the belt moves around a small release roller 32, the sheet releases from it and is picked up by a transport 30 for movement to a fusing station, not shown. The belt 1 is continuously cleaned by a high capacity fur brush cleaning device 34 so that the belt can be used continuously in the process.

It is important that the surface of transfer roller 26 be maintained as clean as possible. However, it would be desirable to eliminate an expensive fur brush or other similar cleaner for that function. Accordingly, transfer roller 26 is connected to a reversible power source 36. When no receiving sheet is in the nip between roller 26 and belt 1, the power source 36 is reversed, for example, to bias roller 26 to positive 500 volts. This creates a field in the nip urging toner from the transfer roller 26 to the photoconductive belt 1. Toner transferred back to the belt is then cleaned off in the cleaning station 34. As pointed out in the above-mentioned U.S. Pat. No. 5,187,526, the cleanliness of the transfer roller is also helped by the use of a hard urethane-like material as a thin coating on its surface.

Unfortunately, the splice portion of the belt has a tendency to pick up toner passing through the toning station to such a degree that the reverse bias is unable to keep some of it from transferring to roller 26. This problem can be eliminated by making transfer roller 26 of such a size that the toner returns to the nip at a subsequent interframe. For example, if the circumference of roller 26 is equal to the pitch of the images or a pitch of multiple images, toner inadvertently transferred from the splice will be transferred back at an interframe and miss the back of the receiving sheet.

Figure 3:
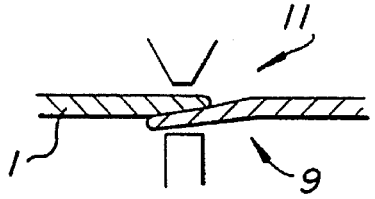
FIGS. 3 and 4 are schematics illustrating two steps in the formation of a splice in a belt.
Figure 4:
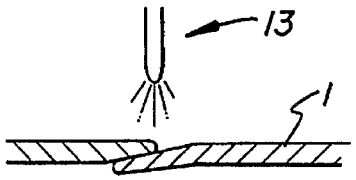

FIGS. 3 and 4 illustrate another solution to this problem. According to FIG. 3 the splice 9 is conventionally made using an ultrasonic horn 11. The ultrasonic horn has a tendency to destroy portions of the very thin conductive layer (or at least separate it from ground) and, in some instances, the photoconductive layer as well.

The conductive layer is conventionally exposed on the edge of the belt, for example, by not coating the photoconductive layers to the edge. Because of the thinness of the conductive layer, it is known to spray or brush a conventional carbon containing conductive lacquer over the exposed edge portion. This improves long life performance of the layer, especially when contacted by brushes. According to FIG. 4, after the splice has been made, it is coated with the same carbon containing conductive lacquer using a spray shown schematically at 13 in FIG. 4. The spray is allowed to cover any area of the splice that could have lost its conductive layer as well as the exposed conductive layer that has not been affected by the splice on the edge. This provides electrical continuity between the surface of the splice and the ground 18. Any suitable approach for coating the splice can be used, since the area is not part of the imaged area and is not critical. For example, the lacquer can be sprayed or brushed on.

The problem may also be solved by using a transfer roller with a small enough circumference that any toner picked up from the splice would be returned to the belt in the same interframe area as the splice. This requires an extremely small transfer roller. Although a very small roller has some other advantages, including a reduction in the tendency of the receiving sheet to wrap on the transfer roller, such a small roller is not usually optimum. Similarly, an overly large interframe at the splice is also not desirable.

Although this splicing problem is most likely to arise with a photoconductive belt, a spliced, grounded belt may also be used as an intermediate image member. The solutions disclosed herein can also be used with such apparatus.

The invention has been described with respect to CAD. If discharged area development (DAD) is used, then the seam area should be maintained at high potential instead of low potential to prevent the pickup of toner. Toner would be inclined to be picked up in a DAD system at the splice if the splicing process destroyed the photoconductive layer without destroying the conductive layer. Although this is less common and less of a problem, it also can happen. Accordingly, the solution to this problem is the opposite of that with a CAD system. That is, an insulative lacquer is applied to the splice so that that area maintains its charge at all times.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

an endless image belt mounted for movement through an endless path, the belt including a splice, means for forming a series of toner images on the belt separated by interframe areas not including toner images, one of said interframe areas including said splice, a rotatable transfer member positioned to urge a receiving sheet into intimate contact with a toner image, and means for creating an electric field between the transfer member and the belt, which field is reversible between a first condition urging transfer of a toner image to a receiving sheet and a second condition urging transfer of any toner on the surface of the transfer member to the belt when no receiving sheet is between the belt and the transfer member, wherein the transfer member has an intrack circumference of a size causing any toner accumulated at the splice of the belt which transfers to the surface of the transfer member to next contact the belt at an interframe area.

2. Image forming apparatus according to claim 1 wherein the intrack circumference of the transfer member is equal to the pitch of the images on the belt.

3. Image forming apparatus according to claim 1 wherein the splice is covered with a conductive lacquer to inhibit the pickup of toner.

* * * * *